United States Patent [19]

Fahy

[11] 4,078,633

[45] Mar. 14, 1978

[54] MODULAR STAGING WITH PLATFORM JACKS

[76] Inventor: Michael B. Fahy, 2 West St., Milton, Mass. 02186

[21] Appl. No.: 656,515

[22] Filed: Feb. 9, 1976

[51] Int. Cl.[2] ..... E04G 3/12; E04G 3/10

[52] U.S. Cl. ..... 182/82; 182/45; 182/145; 182/229; 182/148

[58] Field of Search ..... 182/45, 82, 145, 146, 182/113, 229, 141, 148, 214, 129; 248/354 S, 354 R; 52/638

[56] References Cited

U.S. PATENT DOCUMENTS

| | | | |
|---|---|---|---|
| 232,556 | 9/1880 | Silvius | 182/45 |
| 668,627 | 2/1901 | Crow | 182/148 |
| 1,905,626 | 4/1933 | Hershey | 182/112 |
| 1,937,608 | 12/1933 | Tobin | 182/82 |
| 2,725,210 | 11/1955 | Swartz | 248/354 S |
| 2,798,574 | 7/1957 | Wardell | 182/129 |
| 3,099,103 | 7/1963 | Wright | 182/108 |
| 3,472,338 | 10/1969 | Weidman | 182/113 |
| 3,526,296 | 9/1970 | Stevens | 182/45 |
| 3,548,970 | 12/1970 | Hutchens | 182/141 |

FOREIGN PATENT DOCUMENTS

| | | | |
|---|---|---|---|
| 892,054 | 10/1953 | Germany | 182/82 |
| 276,065 | 9/1951 | Switzerland | 182/229 |

*Primary Examiner*—Reinaldo P. Machado

[57] ABSTRACT

A staging includes sections that are easily transported or stored and in use are detachably joined to form vertical assemblies detachably interconnected by a railing with the assemblies connected to the building by braces. Each vertical assembly includes a support for platform-forming planks and a mechanism by which the platform may be raised or lowered by workmen supported thereby. The staging also includes sections connectable to the vertical assemblies to form roof-supported assemblies having brackets for platform-forming planks.

3 Claims, 16 Drawing Figures

68
69
66
67
65
61
98
23
52
78
70
71
92
52
76
95
79
30A
74
10
77
87
10
75
73
72
23
20
22
60
32
50
13
13
47
49
55
46
52
54
23
53
51
8
8
45
20
21
24
25

MODULAR STAGING WITH PLATFORM JACKS

BACKGROUND REFERENCE

U.S. Pat. No. 996,982
U.S. Pat. No. 1,905,626
U.S. Pat. No. 2,035,294
U.S. Pat. No. 2,928,642
U.S. Pat. No. 3,880,256

BACKGROUND OF THE INVENTION

In the construction and maintenance of the side walls and roofs of buildings, the use of stagings is necessary. The use of appropriately measured timbers is still widespread in spite of the availability of stagings consisting of a metal framework that can be assembled at the job site and dismantled and stored until its reuse is wanted.

All stagings used in servicing the sides of a building include a platform and as the work progresses the platform must be raised. Proposals have been made to enable the platform to be raised and lowered by workmen on the platform by means providing mechanical advantage in so doing.

Where roofing services are required, the usual procedure is to nail plank-supporting brackets to the roof, except in the case of tile or slate roofs, a procedure that has the disadvantage that nail holes are formed in the new roofing and these must be tarred to prevent their becoming sources of leaks.

THE PRESENT INVENTION

The general objective of the present invention is to provide a staging or scaffolding that consists of components that afford maximum ease and convenience in transportation, use and storage, an objective attained with a staging consisting of sections, desirably tubular, detachably interconnected in end-to-end relationship by joints to provide vertical assemblies, each assembly including a brace having a collar detachably assembled about a section thereof and pivotable legs detachably secured to the building and the two assemblies are interconnected by a railing against movement towards and away from each other, the railing including collars detachably assembled about corresponding sections of the two assemblies. A support for platform-forming planks is connected to each assembly for movement vertically thereof.

Another general objective of the invention is to provide the sections of each assembly with vertically series of teeth and each plank support with a mechanism engageable with the teeth and operable by workmen on the platform to raise or lower it, the teeth and mechanism, desirably either of a rack and pinion or of a pawl and ratchet type.

Another general objective of the invention is to provide a staging consisting of vertical assemblies and assemblies including sections joined thereto and provided with roof engaging supports, and a particular objective is to provide a connection between the vertical and roof supported assemblies that enables the latter to have the same pitch angle as the roof, the roof supported assembly provided with brackets for the support of planks.

Other and more specific objectives of the invention will be apparent from the description of preferred embodiments thereof and from the appended claims.

BRIEF DESCRIPTION OF THE DRAWINGS

The accompanying drawings illustrate preferred embodiments of the invention and

THE PREFERRED EMBODIMENTS OF THE INVENTION

Figure 1:
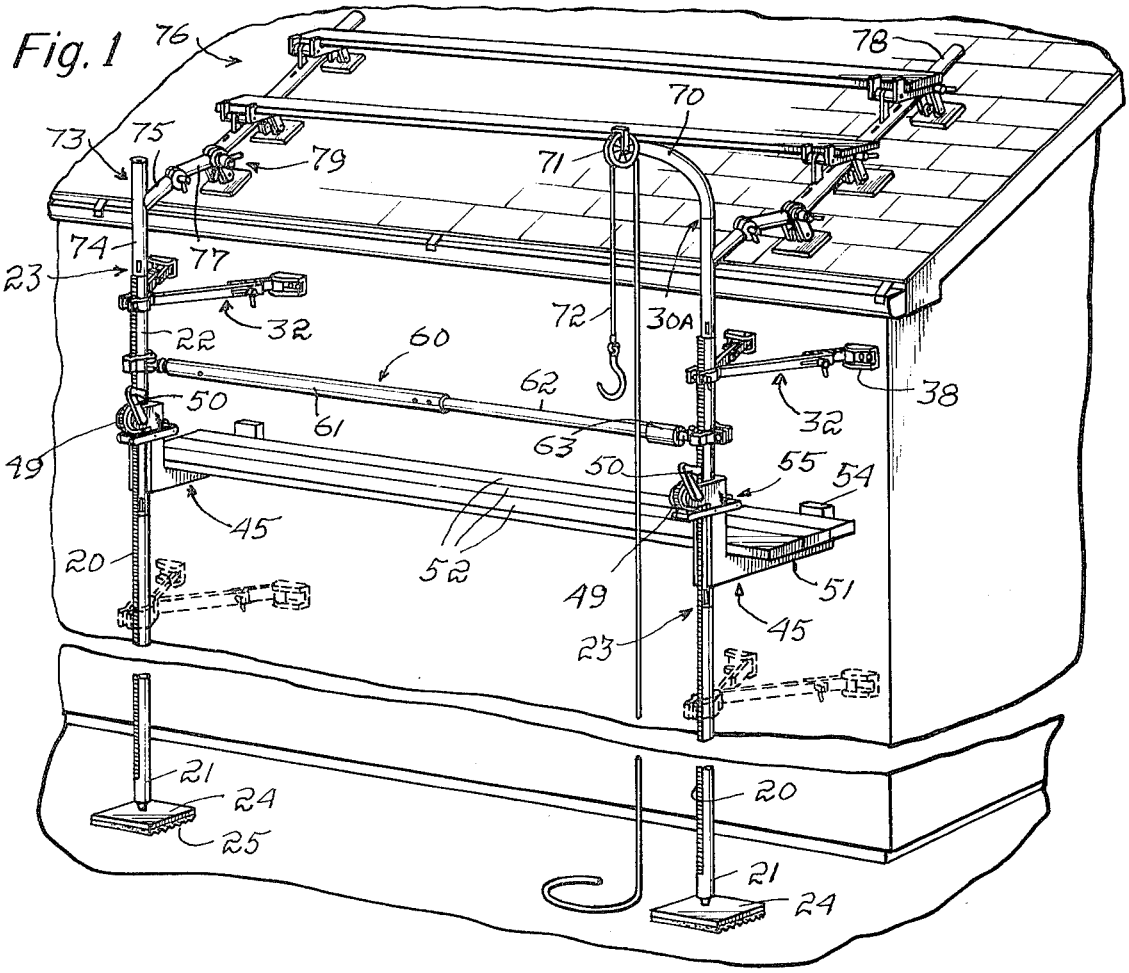
FIG. 1 is a perspective view of an erected staging in accordance with one embodiment of the invention.

The staging illustrated by FIGS. 1 - 14 has two vertical assemblies, each including sections with each provided with a rack portion 20 extending substantially from end-to-end thereof and with the rack portions 20 vertically aligned.

The staging sections include leg sections 21 and, usually, one or more upper sections 22 with the joints between the sections generally indicated at 23. The sections 21 and 22 are shown as tubular and of a diameter to provide adequate strength without excessive weight and, by way of example and not of limitation, the sections 21 may be eight feet long and the upper sections 22, six feet in length. Sections of such lengths may be conveniently stored and transported and easily handled when a staging is being assembled or dismantled.

Each assembly also includes a shoe 24 having a ridged or corrugated, ground-engaging surface 25 and an upwardly disposed ball 26. The lower end of each leg section 21 has a socket 27, see FIG. 2, dimensioned to receive a ball 26 and providing a knuckle joint enabling the leg section 21 supported thereby to be disposed vertically regardless of the nature of the terrain on which an assembly is to be erected.

Figure 8:
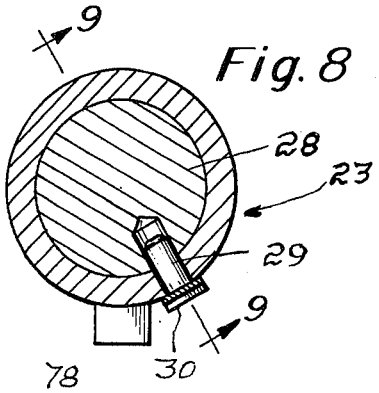
FIG. 8 is a section taken approximately along the indicated line 8—8 of FIG. 7 showing the releasable connection between sections of a staging assembly.
Figure 9:
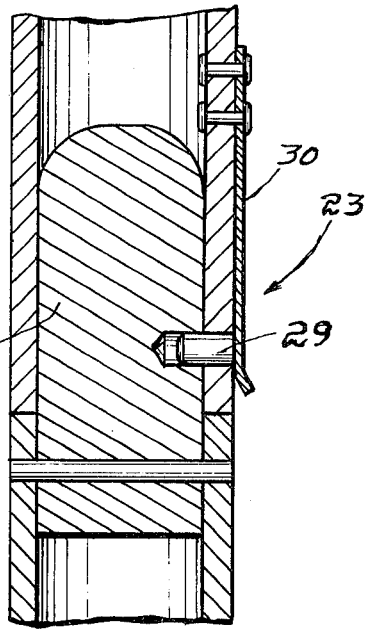
FIG. 9 is a section taken approximately along the indicated line 9—9 of FIG. 8.

The joints 23 between the sections 21 and 22 and other sections later to be described are established, see FIGS. 8 and 9, by means of a pin 28 one end of which is welded in the upper end of a lower section, the in dimensioned and disposed to be a fit within the lower end of an upper section and which and the pin 28 have transversely aligned holes which register when such sections are assembled with the rack portions 20 in alignment to enable a locking pin 29 to be inserted therethrough. Each locking pin 29 is shown as carried by a leaf spring 30 anchored at its end to an upper section.

Figure 3:
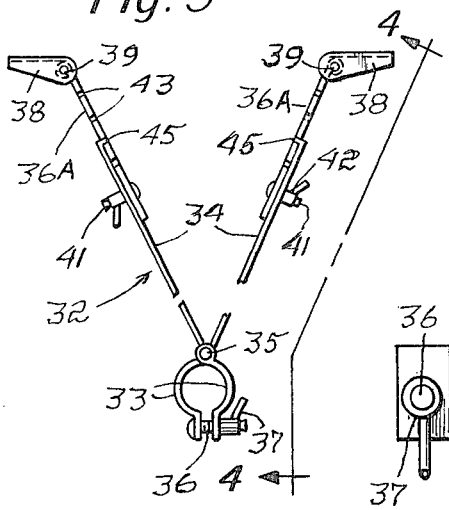
FIG. 3 is a plan view of a brace.
Figure 2:
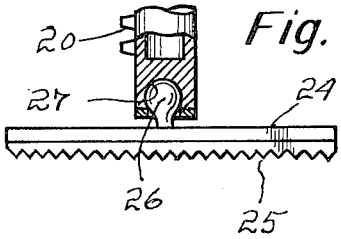
FIG. 2 is a fragmentary and partly sectioned view of a leg section and a foot of a vertical assembly.
Figure 4:
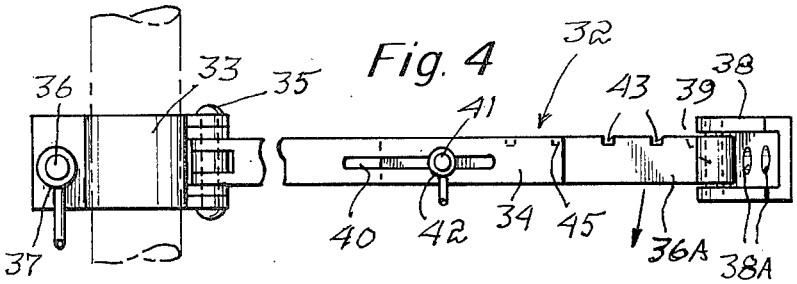
FIG. 4 is a side view of the brace taken approximately along the indicated line 4—4 of FIG. 3 and on a substantial increase in scale.

Each vertical assembly is secured to a side wall 31 of a building by at least one brace generally indicated at 32 and best seen in FIGS. 3 and 4. Each brace 32 includes a split collar consisting of a pair of jaws 33 and a pair of arms 34 with the jaws and arms interconnected by a common pivot 35. The jaws 32 are shaped to be closed about a vertically disposed section and clamped thereto by means of a bolt 36 extending through their free ends and secured as by a locking nut 37. Each arm 34 includes an end section 34A to which a toe 38 is connected by a pivot 39 with the toes 38 having holes 38A to receive nails by which they are anchored to the building. In order that each toe 38 may be properly seated where wanted against the side wall 31, each arm 34 is provided with a lengthwise slot 40 through which extends a threaded pivot 41 carried by the associated arm section 34A and provided with a lock nut 42. The upper edge of each arm section 34A has a series of notches 43 spaced length wise thereof, each dimensioned to receive the locking lug 44 with which the associated arm 34 is provided thereby enabling each arm 34 and its sections 34A to be folded for storage and in use their lengthwise relationship to be adjusted as may be required to bring its toe 38 into proper contact with the building wall 21.

Each vertical platform assembly a supporting unit generally indicated at 45 and having a vertical channel 46 dimensioned slidably to receive a section 21 or 22 and provided with arms 47 at its upper end rotatably supporting the shaft 48 of a pinion 49 which is in mesh with the rack portion 20 of the section within the channel 46. A crank 50 is fixed on each end of the shaft 48. At the lower end of the channel 46 there are bracket arms 51 extending towards the building and desirably of a length enabling three nine-inch planks 52 to be supported thereby and corrugated as at 53 to provide a non-slip surface for them, the planks typically sixteen feet in length and the arm 51 provided with an end plate 54 to retain them. It will be apparent that with a supporting unit 45 fitted on a section, its pinion 49 may be rotated either to raise or lower it. In order to hold a unit 45 in a selected vertical position, a lock generally indicated at 55 is provided to prevent the rotation of its pinion 49. The lock 55 is shown as a yoke 56 straddling the channel 46 and pivotally connected thereto and provided at one end with a portion 57 having at least one locking tooth that fits between pinion teeth when the other end of the yoke 56 is suitably depressed. The other end of the yoke 56 supports a rotatable cam 58 having an arm 50 by which the cam 58 may be turned into and out of locking engagement with the locking portion 56A. A spring 56B serves to ensure disengagement of the end portion 57 from the pinion 49.

Figure 5:
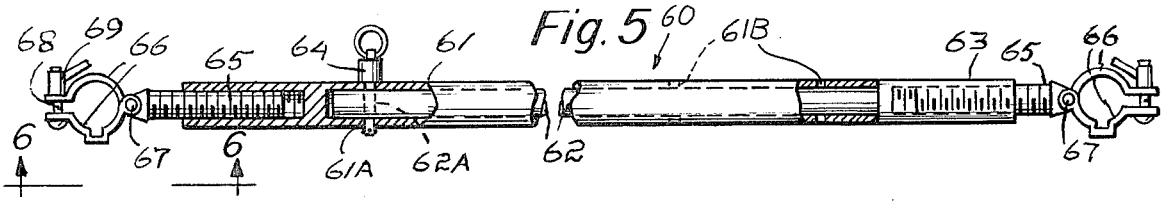
FIG. 5 is a partly sectioned view of a safety railing for use in interlocking two vertical assemblies.
Figures 6, 7:
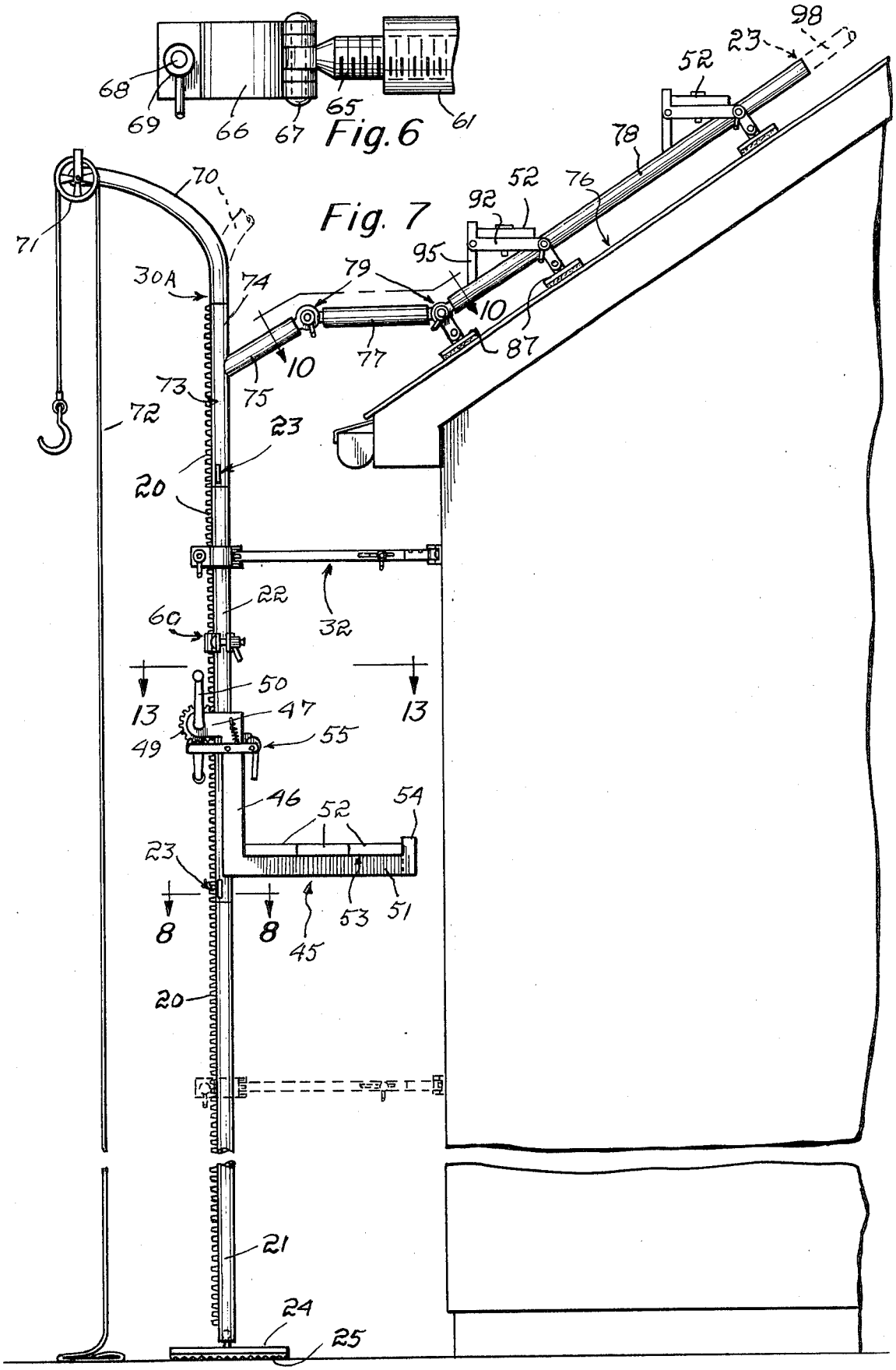
FIG. 6 is a fragmentary view taken approximately along the indicated line 6—6 of FIG. 5 and on a substantial increase in scale.
FIG. 7 is an end view of the staging shown in FIG. 1.

The two vertical assemblies are interconnected above the platform against movement towards and away from each other by a railing, generally indicated at 60. The railing 60, see FIG. 5, includes a first tubular section 61 and a second section 62 dimensioned to be a slidable fit therein and provided with a tubular head 63 desirably of the same stock as that used for the section 61. When, as shown in FIG. 5, the railing sections are telescoped together, they are interconnected by a locking pin 64 extending through holes 61A in the outer end of the section 61 and a transverse bore 62A adjacent the inner end of the section 62.

Threaded in the remote end of the first section 61 and the head 63 are shanks 65 to which the jaws 66 of a split collar are connected by a pivot 67. The free ends of the jaws 66 of each collar are connected about the appropriate section of the vertical assemblies by a bolt 68 on which is threaded a locking nut 69.

An important function of the railing 60 is to ensure that the two vertical staging assemblies are spaced apart a distance such that the planks 52 have a substantial overhang relative to the arms 51. As the vertical assemblies may not be spaced apart the maximum distance that permits such an overhang, means are provided to interconnect the two sections of the railing 60 in different extended relationships, conveniently by providing a series of holes 61B in the opposite end of the section 61. The locking pin 64 may be inserted into whichever one of the holes 61B and the bore 62A establishes the desired railing length and, if necessary, the collar shanks 65 may be turned to make similar adjustments.

The braces 32 are removed and replaced as needed and as the platform is raised or lowered, the workmen move the railing 60 from time-to-time in the appropriate desired direction. It will be apparent that a generally similar procedure is followed in dismantling the staging.

One of the vertical assemblies is shown as having a curved end section 70 provided with a pulley 71. The joint 30A between it and the uppermost section of the assembly is identical to the joints 20 except that it is not locked thus enabling the section 70 to be turned. With a rope 72 trained about the pulley 70, paint pails, bales of shingles, siding, paper and the like may be easily raised to the appropriate level and pulled onto the platform by a workman standing thereon.

From the foregoing, it will be apparent that a staging may be easily and quickly assembled along a side of a building with the shoes 24 so located that leg sections 21, when held vertically thereon, will be as close as conveniently possible to fifteen feet apart. When the two leg sections 21 are thus positioned, they may be connected to the building by braces 32, usually after the units 45 have been installed. With the planks 52 placed on the bracket arms 51, the staging is ready for use and can be raised or lowered by the workman as required.

For roof work, roof-supported assemblies are provided, one for each vertical assembly and connected thereto by a section, generally indicated at 73. Each section 73 includes a vertical length of tubular portion 74 connected to the uppermost section by a joint 23 and is shown as supporting a curved end section 70. Each section 73 also includes a short tubular portion 75 between its end that is in an upwardly inclined position to provide an arm extending towards and above but close to the eaves of the roof 76. The sections 73 are hereinafter sometimes referred to as Y-sections.

Figure 10:
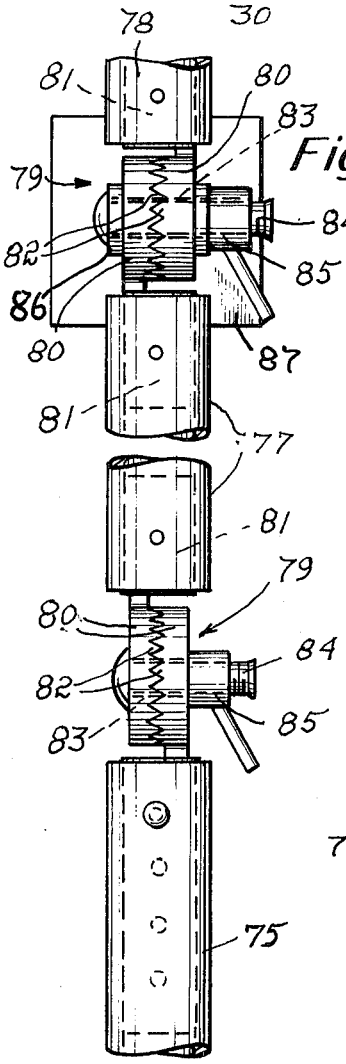
FIG. 10 is a view on a substantial increase in scale, taken approximately along the indicated line 10—10 of FIG. 7.
Figure 11:
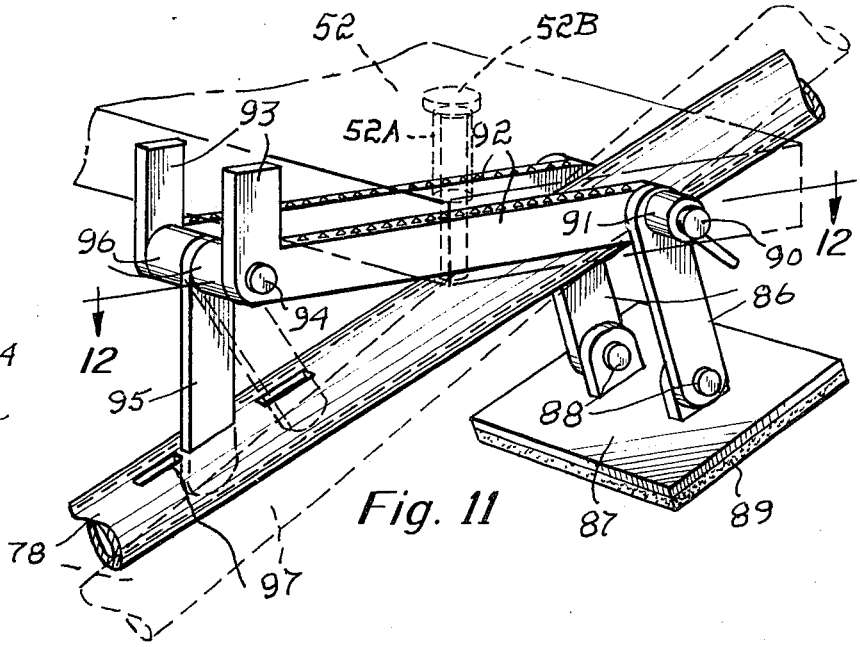
FIG. 11 is a fragmentary, perspective view of a section of the roof-supported assembly and parts connected thereto.
Figure 12:
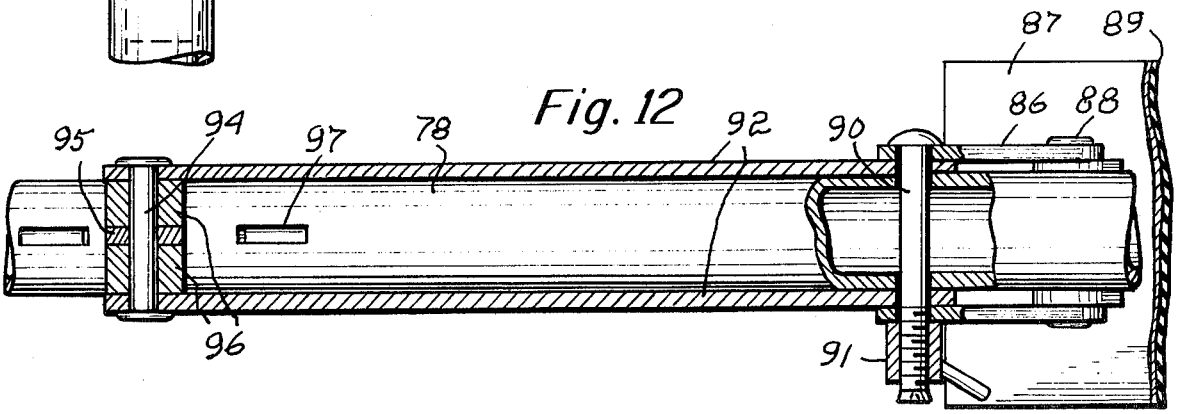
FIG. 12 is a section, on an increase in scale, taken approximately along the indicated line 12—12 of FIG. 11.
Figure 13:
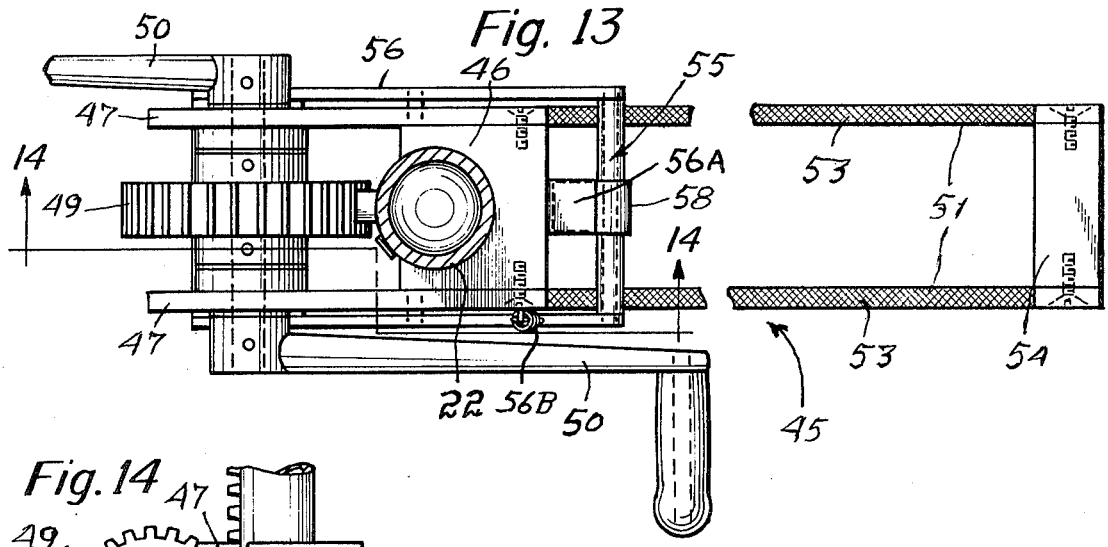
FIG. 13 is a fragmentary view, on a substantial increase in scale, taken approximately along the indicated line 13—13 of FIG. 7.
Figure 14:
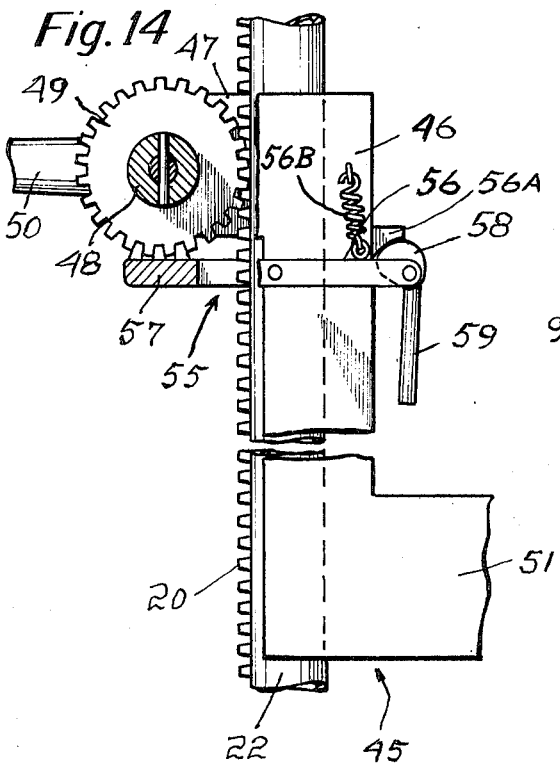
FIG. 14 is a section taken approximately along the indicated line 14—14 of FIG. 13.

A relatively short, tubular connecting section 77 is attached to each of the arms 75 and to a first roof staging section 78 by pivotable connections generally indicated at 79 and of a type, see FIG. 10, that can be positively locked with the sections 77 and 78 in an angular relationship such that the section 78 is above and parallel to the roof 76. In order to avoid the use of short sections in the vertical assemblies, the sections 77 are of sufficient length to ensure the required positions of the sections 78 regardless of the spacing of the arm 75 vertically from the roof 76.

Each pivotable connection 79 includes a circular seat 80 having a shank 81 secured in the end or ends of the sections interconnected thereby. Each seat 80 is provided with radial teeth 82 in a plane inclusive of the axis of that section to which it is connected and a concentric bore 83 for a threaded pivot bolt 84 with the teeth 82 of the two seats 80 engageable when the pivotally interconnected sections are disposed at the desired angle and are locked in engagement when the nut 85 is tightened on the pivot bolt 84.

Each roof staging section 78 is provided with a plurality of roof engaging supports each of which consists of legs 86 provided with a base 87 connected thereto by transverse pivots 88. Each base 87 is of substantial area and is provided with a rubber facing 89 ensuring that the roof staging will not damage the roofing. The section 78 is shown as having three such supports, one having its legs 86 supported by the pivot 84 of the connection 79 between it and the connecting section 77 and the others connected to the section 78 by transverse threaded pivots 90, each provided with a clamping nut 91. Each pivot 90 also supports a pair of arms 92 for the support of a plank 52 and provided with a rear, retaining shoulder 93. The arms 92 are interconnected by a pivot 94 carrying a support 95 between spacers 96. Each support 95 is entered into that one of a series of slots 97 that provides the best position for the arms 92 in supporting a plank. The angular relation of the leg 86 is maintained when the clamping nuts 91 are secured. The roof staging assemblies also may include second sections 98 connected thereto as by a joint 23 and as these are otherwise identical to the sections 78 they are not detailed. It is preferred that the planks 52 be provided with bores 52A in positions such that a bolt 52B may be inserted therethrough and enter between arms 92 to interconnect the roof-supported assemblies.

Figure 15:
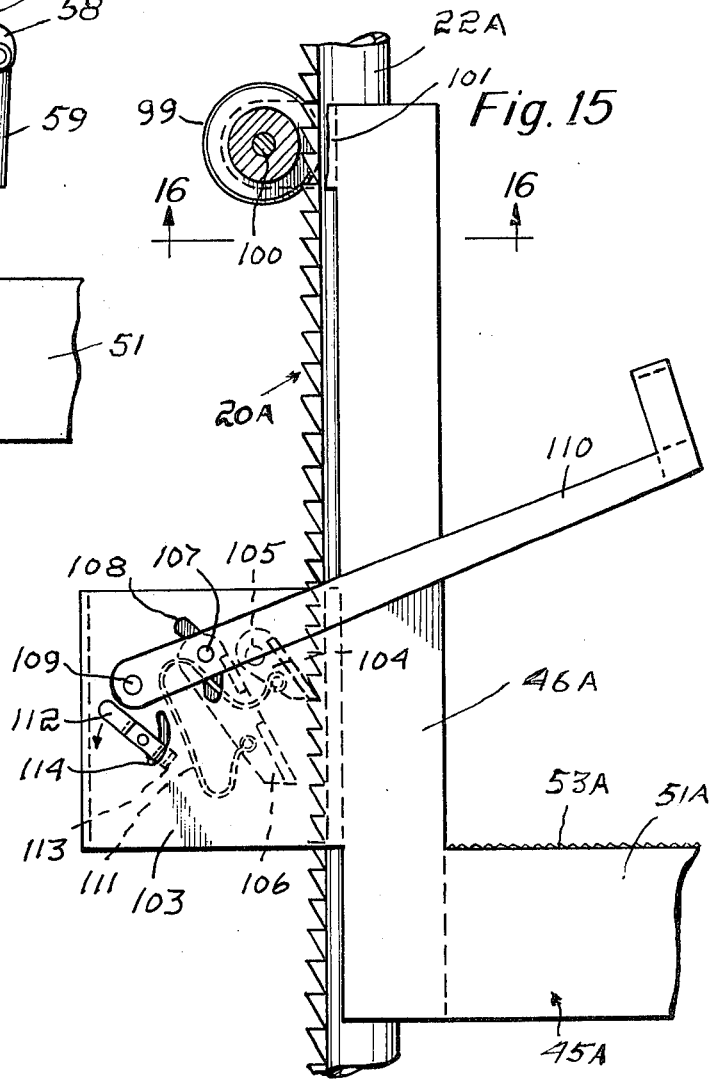
FIG. 15 is a view of platform elevating means in accordance with another embodiment of the invention.
Figure 16:
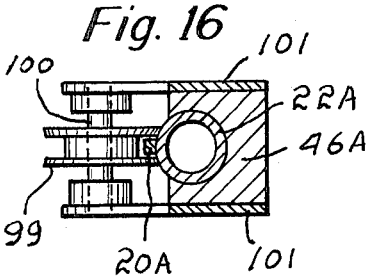
FIG. 16 is a section taken approximately along the indicated line 16—16 of FIG. 15.

In FIGS. 15 and 16, a platform supporting unit in accordance with another embodiment of the invention is shown. In this embodiment of the invention, the platform is to be raised and lowered by a reversible pawl and ratchet feed such, for example, as those used in jacks and as the vertical assemblies are or may be otherwise the same, corresponding parts are indicated by the suffix addition "A" to the appropriate reference numerals and they and their uses are not again described.

The vertical channel 46A of the supporting unit 45A slidably receives a section, the section 22A, for example, the sections having lengthwise portions 20A provided with ratchet teeth and is held therein by a roller 99 the shaft 100 for which is supported by a pair of arms 101, the roller 99 having a peripheral groove 102 dimensioned to accommodate the ratchet portion 20A.

At the lower end of the channel 46A, there is a housing 103 within which there is a first pawl 104 attached to the side walls of the housing 103 by a pivot 105 and shown in engagement with ratchet teeth. A second pawl 106 has a pivot 107 slidably confined in slots 108 in the housing side walls that are arcuate with respect to the pivot 109 of the operating treadle 110 that extends beyond the opposite side of the channel 46A in a position to be operated by a workman on the platform and to which the pivot 107 is connected. A spring 111 attached to the pawls 104 and 106 is shown as yieldably seating the pawl 104 and engageable by the pivot 107 as the treadle 110 is depressed. A direction shifter 112 is pivotally connected to the outside of the housing 103 and includes a portion 113 extending into the housing through an arcuate slot 114 in a position to engage the central part of the spring 111 when the shifter is pivoted from its position shown in FIG. 15, then to yieldably maintain the pawl 106 in engagement with ratchet teeth.

I claim:

1. A portable staging for the support of platform-forming planks adjacent the side of a building, said staging comprising two vertical assemblies, each assembly including a ground engaging foot, a lower section connected to said foot, and at least one upper section, said upper section detachably connected to said lower section, each section provided with a series of rack teeth extending lengthwise thereof, the series of teeth of the sections of each assembly aligned with one series a continuation of the other, platform units, one for each assembly and attached thereto for movement vertically along its sections, each unit including a vertical portion of substantial length and a right-angular, plank supporting portion at the lower end thereof disposed towards the building, said teeth disposed in the opposite direction, said vertical portion slidably connected to a section with said teeth exposed, said vertical portion including structure extending beyond said section in said opposite direction, and means adjacent the upper end of said vertical portion includes a pinion in mesh with said teeth, a transverse shaft and a crank at least at one end thereof supported by said structure, and operable by a workman on the platform to effect said vertical movement, brace means attachable to the building, each brace means including a collar detachably assembled about a section of each assembly, and a railing above said units including collars each detachably assembled about a corresponding section of a respective one of said assemblies, means to lock said pinion against turning including a lever pivotally connected to the channel and provided at one end with at least one locking tooth disposed for entry between pinion teeth when the lever is in a predetermined position, and coacting cam means operable to detachably connect the other end of the lever to the unit against movement when the locking tooth is in its locking position.

2. A portable staging comprising first and second assemblies, said second assemblies including a series of sections detachably interconnected in an end-to-end relationship, said first assemblies extending vertically substantially to the eaves of the building, said second sections extending upwardly along the roof angularly relative to said vertical section and above the roof with at least one section of each assembly parallel to the roof, said section including plank supporting brackets and supports in contact with the roof, and means connecting said vertical and roof-supporting assemblies and adjustable as required by the pitch of the roof and the spacing of said second sections relative thereto to effect the relationship of said first sections relative to the roof, each connecting means including an arm attached at an angle to the uppermost vertical section, and an intermediate linking section, transverse pivot means interconnecting said linking section to said arm and to said one roof support section.

3. The portable staging of claim 2 in which each support of said one section includes a leg and a pivotable base, and each bracket includes a pivot connecting the front end thereof to said section and means connecting the rear section thereof to said section and enabling the angular relation of the bracket to be varied, said leg also conneted to said section by said pivot.

* * * * *